US009478947B2

(12) United States Patent
Mukoyama et al.

(10) Patent No.: US 9,478,947 B2
(45) Date of Patent: Oct. 25, 2016

(54) PLASMA JET SPARK PLUG

(71) Applicant: NGK Spark Plug Co., LTD., Nagoya (JP)

(72) Inventors: Naoyuki Mukoyama, Nisshin (JP); Hiroyuki Kameda, Nagakute (JP); Daisuke Kasahara, Anjo (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 14/811,160

(22) Filed: Jul. 28, 2015

(65) Prior Publication Data

US 2016/0028214 A1 Jan. 28, 2016

(30) Foreign Application Priority Data

Jul. 28, 2014 (JP) ..... 2014-153106

(51) Int. Cl.
*H01T 13/32* (2006.01)
*H01T 13/52* (2006.01)
*H01T 13/54* (2006.01)

(52) U.S. Cl.
CPC ..... *H01T 13/32* (2013.01); *H01T 13/52* (2013.01); *H01T 13/54* (2013.01)

(58) Field of Classification Search
CPC ..... F02P 9/007; H01T 13/54; H01T 21/02
See application file for complete search history.

(56) References Cited

U.S. PATENT DOCUMENTS 4,713,574 A 12/1987 Scott
2008/0238281 A1* 10/2008 Nakamura ..... H01T 13/54 313/141
2011/0221327 A1 9/2011 Kameda et al.
2012/0242214 A1* 9/2012 Kameda ..... H01T 13/54 313/141

FOREIGN PATENT DOCUMENTS

JP 55-51827 U 4/1980
JP 2009-146636 A 7/2009
JP 2011-210709 A 10/2011
JP 2012-190782 A 10/2012

OTHER PUBLICATIONS

Office Action mailed Jun. 21, 2016 for the corresponding Japanese Patent Application No. 2014-153106.

* cited by examiner

*Primary Examiner* — Nimeshkumar Patel
*Assistant Examiner* — Jacob R Stern
(74) *Attorney, Agent, or Firm* — Leason Ellis LLP

(57) ABSTRACT

A plasma jet plug has a cavity defined by a surface of a center electrode, an inner surface of an insulator, and a surface of a ground electrode. When a volume of a portion of the cavity on a front side of a front portion of the center electrode is a first volume V1 and a volume of a portion of the cavity on a rear side of the front end of the center electrode is a second volume V2, the following expression is satisfied:

$V1/V2 \geq 0.20$.

14 Claims, 5 Drawing Sheets

PLASMA JET SPARK PLUG

This application claims the benefit of Japanese Patent Application No. 2014-153106, filed Jul. 28, 2014, which is incorporated by reference in its entities herein.

FIELD OF THE INVENTION

The present invention relates to a plasma jet plug for igniting an air-fuel mixture in an internal combustion engine.

BACKGROUND OF THE INVENTION

A plasma jet plug is known as an example of a spark plug for igniting an air-fuel mixture in an internal combustion engine (for example, PTL 1). The plasma jet plug has a discharge space (also referred to as a cavity) which is surrounded by an insulator, such as a ceramic, and in which a gap is provided between a center electrode and a ground electrode. When a spark is generated (discharge occurs) in the gap, the gas in the cavity is excited and plasma is generated in the cavity. The generated plasma is ejected out of the cavity, so that the air-fuel mixture is ignited. The ejected plasma is capable of quickly reaching positions far from the plasma jet plug. Therefore, unlike a spark plug that directly ignites the air-fuel mixture with a spark (discharge), the plasma jet plug is capable of appropriately igniting a lean air-fuel mixture having a high air/fuel ratio.

CITATION LIST

Patent Literature

[PTL 1] Japanese Unexamined Patent Application Publication No. 2011-210709

[PTL 2] U.S. Pat. No. 4,713,574

TECHNICAL PROBLEM

Unfortunately, the plasma jet plug cannot easily generate a strong plasma jet. For example, when the size of the cavity is reduced to generate a strong plasma jet, the insulator surrounding the cavity is damaged by the spark and there is a risk that the strong plasma jet cannot be generated continuously.

The main advantage of the present invention is that performance of a plasma jet plug can be improved.

SUMMARY OF THE INVENTION

Solution to Problem

The present invention has been made to solve at least part of the above-described problem, and may be realized by way of the following application examples.

APPLICATION EXAMPLE 1

A plasma jet plug comprising:

a tubular insulator having an inner surface that defines an axial hole that extends along an axis;

a rod-shaped center electrode that is disposed in the axial hole of the insulator and extends along the axis;

a metallic shell disposed around an outer periphery of the insulator;

a ground electrode that is electrically connected to the metallic shell, said ground electrode having a through hole and being disposed on a front side of the insulator; and a cavity that is defined by a surface of the center electrode, the inner surface of the insulator, and a surface of the ground electrode, wherein, the following expression is satisfied:

$V1/V2 \geq 0.20$, where a first volume V1 is a volume of a portion of the cavity on the front side of a front end of the center electrode, and a second volume V2 is a volume of a portion of the cavity on a rear side of the front end of the center electrode.

With this structure, compared to the case in which the ratio of the first volume V1 of the front portion of the cavity to the second volume V2 of the rear portion of the cavity is low, the performance of the plasma jet plug can be improved.

APPLICATION EXAMPLE 2

The plasma jet plug according to Application Example 1, wherein the through hole has a maximum width that is smaller than or equal to 0.7 mm.

With this structure, compared to the case in which the maximum width of the through hole is large, the plasma ejection performance can be improved.

APPLICATION EXAMPLE 3

The plasma jet plug according to Application Example 1 or 2, wherein the front end of the center electrode has a maximum width that is greater than or equal to 1.3 mm.

With this structure, compared to the case in which the maximum width of the front end of the center electrode is small, the amount by which the gap between the center electrode and the ground electrode is increased due to wear of the center electrode can be reduced. Therefore, the durability of the plasma jet plug can be increased and the plasma ejection performance can be improved at the same time.

APPLICATION EXAMPLE 4

The plasma jet plug according to any one of Application Examples 1 to 3, wherein the cavity includes a first portion provided at the front side of the center electrode, and a second portion that is located on the rear side of the first portion and has an inner diameter smaller than an inner diameter of the first portion.

With this structure, the possibility that discharge will occur along the inner surface of the insulator can be reduced, so that damage to the insulator caused by sparks can be suppressed. As a result, the damage to the insulator can be suppressed and the plasma ejection performance can be improved at the same time.

APPLICATION EXAMPLE 5

The plasma jet plug according to Application Example 4, wherein the second portion is located on the rear side of the front end of the center electrode.

With this structure, the possibility that discharge will occur along the inner surface of the insulator can be further reduced. Therefore, the damage to the insulator can be further suppressed and the plasma ejection performance can be improved at the same time.

APPLICATION EXAMPLE 6

The plasma jet plug according to any one of Application Examples 1 to 5, wherein the following expression is satisfied:

$$V1/V2 \geq 0.62.$$

With this structure, the volume of the cavity is not excessively large, and the plasma can be appropriately generated in the front portion of the cavity. Therefore, the ejection performance can be improved.

The present invention can be realized in various embodiments, such as a plasma jet plug, an ignition system including the plasma jet plug, an internal combustion engine including the plasma jet plug, or an internal combustion engine including the ignition system including the plasma jet plug.

BRIEF DESCRIPTION OF DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

A. First Embodiment

A-1. Overall Structure of Plasma Jet Plug

Figure 1:
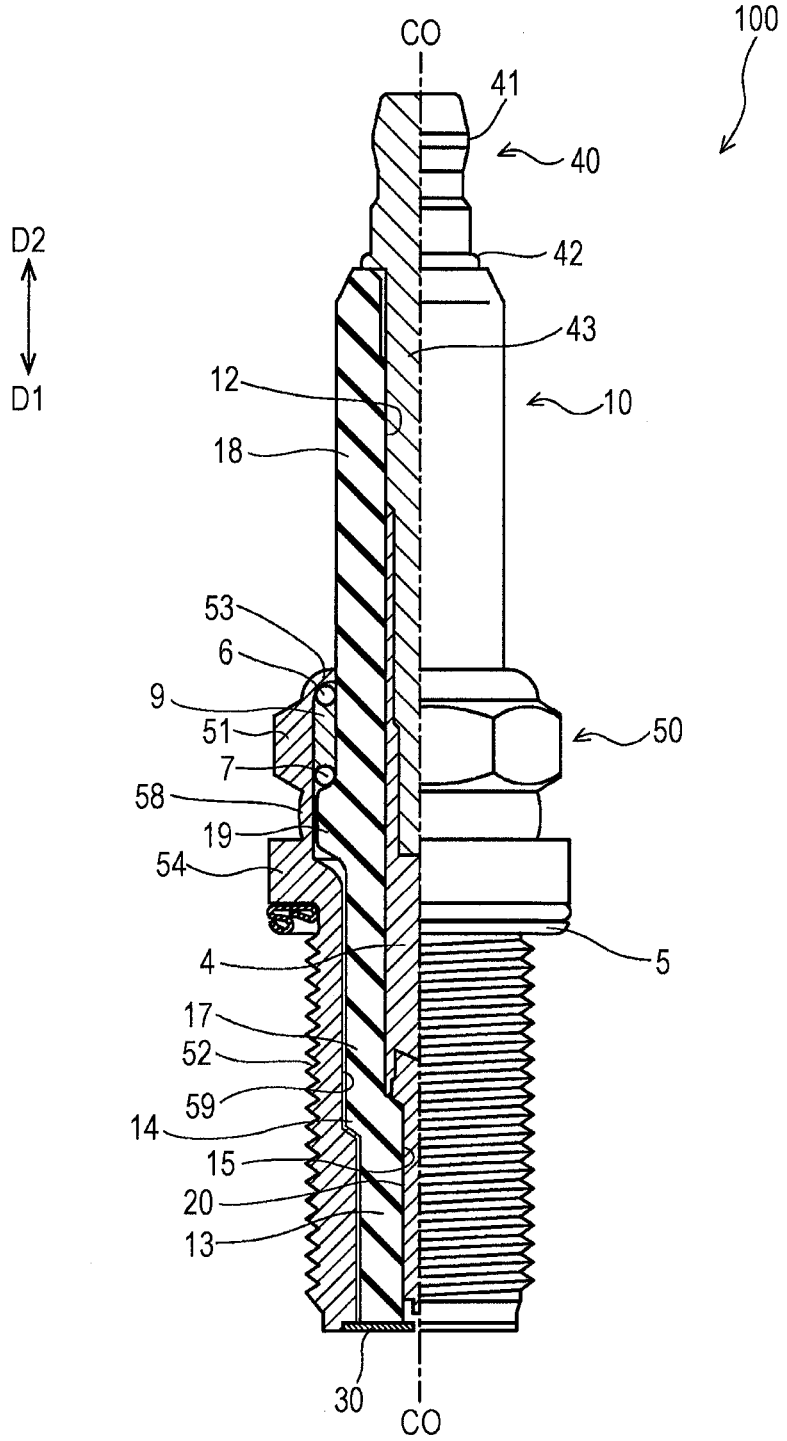
FIG. 1 is a diagram illustrating the overall structure of a plasma jet plug 100 according to an embodiment.
Figure 2:
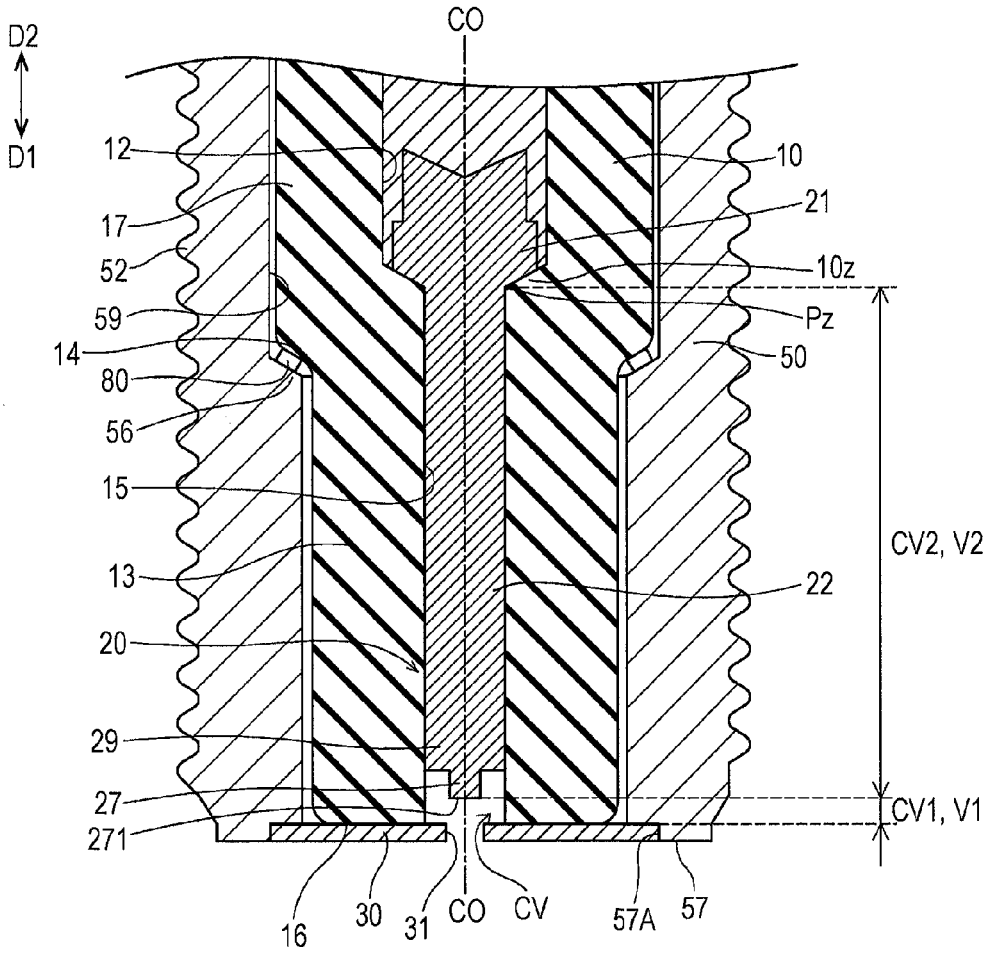
FIG. 2 is a sectional view of a portion of the plasma jet plug 100 around a center electrode 20.

FIG. 1 is a diagram illustrating the overall structure of a plasma jet plug 100 according to an embodiment. In FIG. 1, the part on the right side of the axis CO shows the appearance of the plasma jet plug 100, and the part on the left side of the axis CO shows a sectional view taken along a plane including the axis CO. FIG. 2 is a sectional view of a portion of the plasma jet plug 100 around a center electrode 20. In FIGS. 1 and 2, the one-dot chain line CO shows the axis of the plasma jet plug 100. The direction parallel to the axis CO (vertical direction in FIGS. 1 and 2) may be referred to as "direction of the axis CO", or simply as "axial direction". The radial direction of a circle centered on the axis CO may be referred to simply as "radial direction", and the circumferential direction of a circle centered on the axis CO may be referred to simply as "circumferential direction". The downward direction in FIGS. 1 and 2 is also referred to as a front direction D1, and the upward direction in FIGS. 1 and 2 is also referred to as a rear direction D2. The lower side in FIGS. 1 and 2 is referred to as a front side of the plasma jet plug 100, and the upper side in FIGS. 1 and 2 is referred to as a rear side of the plasma jet plug 100.

The plasma jet plug 100 includes an insulator 10 (also referred to as electrical porcelain), the center electrode 20, a ground electrode 30, a terminal 40, and a metallic shell 50 (FIG. 1).

The insulator 10 is obtained by firing alumina or the like. The insulator 10 is a substantially cylindrical member (tubular body) that extends in the axial direction and that has an axial hole 12 that extends through the insulator 10. The insulator 10 includes a flange 19, a rear body 18, a front body 17, a step portion 14, and an elongated leg 13. The rear body 18 is on the rear side of the flange 19, and has an outer diameter smaller than that of the flange 19. The front body 17 is on the front side of the flange 19, and has an outer diameter smaller than that of the rear body 18. The elongated leg 13 is on the front side of the front body 17, and has an outer diameter smaller than that of the front body 17. The step portion 14 has an outer diameter that decreases toward the end thereof in the front direction D1, and is disposed between the elongated leg 13 and the front body 17 of the insulator 10.

A portion of the axial hole 12 that is defined by the inner surface of the elongated leg 13 serves as an electrode receiving hole 15 (FIG. 2). A thinning hole portion 10*z*, which has an inner diameter that decreases toward the end thereof in the front direction D1, is formed in a region in the rear direction D2 from the electrode receiving hole 15. The inner diameter is substantially constant in a region in the rear direction D2 from the thinning hole portion 10*z*.

The metallic shell 50 (FIG. 1) is made of a conductive metal material (for example, low-carbon steel material). The metallic shell 50 is a substantially cylindrical member (tubular body) used to fix the plasma jet plug 100 to an engine head (not shown) of an internal combustion engine. The metallic shell 50 has a through hole 59 that extends through the metallic shell 50 along the axis CO. The metallic shell 50 is disposed around the outer peripheries of a front portion of the rear body 18, the flange 19, the front body 17, and the elongated leg 13 of the insulator 10. More specifically, the insulator 10 is inserted and held in the through hole 59 in the metallic shell 50.

The metallic shell 50 includes a tool engagement portion 51 having a hexagonal columnar shape that engages with a spark plug wrench, a threaded portion 52 which is to be attached to the internal combustion engine, and a flange-shaped seating portion 54 provided between the tool engagement portion 51 and the threaded portion 52.

An annular gasket 5 formed by bending a metal plate is disposed between the threaded portion 52 and the seating portion 54 of the metallic shell 50. The gasket 5 seals the gap between the plasma jet plug 100 and the internal combustion engine (engine head) when the plasma jet plug 100 is attached to the internal combustion engine.

The metallic shell 50 further includes a thin-walled crimping portion 53 provided on the rear side of the tool engagement portion 51 and a thin-walled compressive deformation portion 58 provided between the seating portion 54 and the tool engagement portion 51. Annular ring members 6 and 7 are disposed in an annular space between the inner surface of a portion of the metallic shell 50 that extends from the tool engagement portion 51 to the crimping portion 53, and the outer peripheral surface of the rear body 18 of the insulator 10. In this space, the region between the two ring members 6 and 7 is filled with powder of talc 9. The inner surface of the metallic shell 50 that defines the through hole 59 has a diameter that decreases from the rear side toward the front side in a central region of the threaded portion 52 in the axial direction. Thus, a step-shaped engagement portion 56 is formed on the inner surface (FIG. 2).

The rear end of the crimping portion 53 (FIG. 1) is bent radially inward. The compressive deformation portion 58 of the metallic shell 50 is compressed when the crimping portion 53 fixed to the outer peripheral surface of the insulator 10 is pressed in the front direction in the manufacturing process. Owing to the compressive deformation of the compressive deformation portion 58, the insulator 10 is pressed in the front direction by the ring members 6 and 7 and the talc 9 in the metallic shell 50. As a result, the step portion 14 of the insulator 10 is pressed against the engagement portion 56 on the inner surface of the metallic shell 50 with an annular plate packing 80 (FIG. 2) made of a metal interposed therebetween. As a result, the space between the step portion 14 of the insulator 10 and the engagement portion 56 of the metallic shell 50 is sealed by the plate packing 80. As a result, the gas in the combustion chamber of the internal combustion engine is prevented from leaking out through the gap between the metallic shell 50 and the insulator 10.

The center electrode 20 (FIG. 2) is a rod-shaped member that extends along the axis CO, and is disposed in the axial hole 12 in the insulator 10. In the present embodiment, the center electrode 20 is an integral part made of a high melting material, such as tungsten. However, the center electrode 20 may have various other structures. For example, the center electrode 20 may have a dual structure including a base and a core embedded in the base. The base is made of, for example, nickel or an alloy containing nickel as a main component (INCONEL 600 (INCONEL is a registered trademark) or the like). The main component is a component with the highest percentage content (weight percent). The core is made of, for example, a material having a thermal conductivity higher than that of the material of the base (for example, copper or an alloy containing copper as a main component).

The center electrode 20 includes a head 21 and a leg 22 that is on the front side of the head 21 and that has an outer diameter smaller than that of the head 21. The leg 22 of the center electrode 20 is accommodated in the electrode receiving hole 15, which is a portion of the axial hole 12 in the insulator 10, and the head 21 of the center electrode 20 is accommodated in a portion of the axial hole 12 that extends in the rear direction D2 from the thinning hole portion 10*z*. As described below, when the terminal 40 (FIG. 1) is inserted into the axial hole 12 from the rear end of the axial hole 12, the head 21 is pressed against the thinning hole portion 10*z*. As a result, a surface of the head 21 facing in the front direction D1 and a surface of the thinning hole portion 10*z* facing in the rear direction D2 come into tight contact with each other. Thus, the gap between the head 21 and the thinning hole portion 10*z* is sealed over the entire circumference in the circumferential direction. The position Pz in the figure is the position at the end of the sealed region in the front direction D1 (hereinafter also referred to as the sealing position Pz).

The leg 22 of the center electrode 20 includes a first portion 27 that includes the front end and a second portion 29 that connects the first portion 27 to the head 21. The outer diameter of the first portion 27 is smaller than the outer diameter of the second portion 29.

The ground electrode 30 (FIG. 2) is fitted to a recess 57A that is formed in an inner peripheral portion of a front end surface 57 of the metallic shell 50 and recessed in the rear direction D2. As illustrated in FIG. 2, the ground electrode 30 is an O-shaped plate member (in other words, a disc-shaped member) having a through hole 31 at the center. The ground electrode 30 is fitted to the recess 57A such that the thickness direction thereof is the direction of the axis CO, and such that the ground electrode 30 is in contact with a front end surface 16 of the insulator 10 or is spaced from the front end surface 16 by a small gap (for example, a gap of 0.05 mm or less). The rim of the ground electrode 30 is bonded to the metallic shell 50 by laser welding or the like over the entire circumference. Thus, the metallic shell 50 and the ground electrode 30 are electrically connected to each other. The ground electrode 30 covers the opening at the end of the metallic shell 50 in the front direction D1. The ground electrode 30 is made of an alloy containing iridium as a main component (other materials may be used instead).

A cavity CV for generating plasma is formed between a surface of the center electrode 20 facing in the front direction D1 and a surface of the ground electrode 30 facing in the rear direction D2 in the electrode receiving hole 15 of the insulator 10. This will be described in detail below. When a voltage is applied between the center electrode 20 and the ground electrode 30, a discharge occurs in a space (that is, a gap) between the center electrode 20 and the ground electrode 30, which is located in the front direction D1 from the center electrode 20, in the cavity CV.

The terminal 40 (FIG. 1) is a rod-shaped member that extends along the axis CO. The terminal 40 is formed of a conductive metal material (for example, a low-carbon steel), and the surface thereof is covered with a metal layer (for example, a Ni layer), formed by plating or the like, to prevent corrosion. The terminal 40 includes a flange 42 formed at a predetermined position in the axial direction, a cap attachment portion 41 provided on the rear side of the flange 42, and a leg 43 provided on the front side of the flange 42. The cap attachment portion 41, which includes the rear end of the terminal 40, projects from the rear end of the insulator 10. The leg 43, which includes the front end of the terminal 40, is inserted into the axial hole 12 in the insulator 10. A plug cap to which a high-voltage cable (not shown) is connected is fitted to the cap attachment portion 41, and a high voltage is applied to generate a spark.

A conductive seal 4 is disposed in a region between the leg 43 of the terminal 40 and the center electrode 20 in the axial hole 12 of the insulator 10. The terminal 40 and the center electrode 20 are electrically connected to each other by the conductive seal 4. The conductive seal 4 is formed of, for example, a composite containing metal particles and ceramic particles, such as glass particles.

Figure 3:
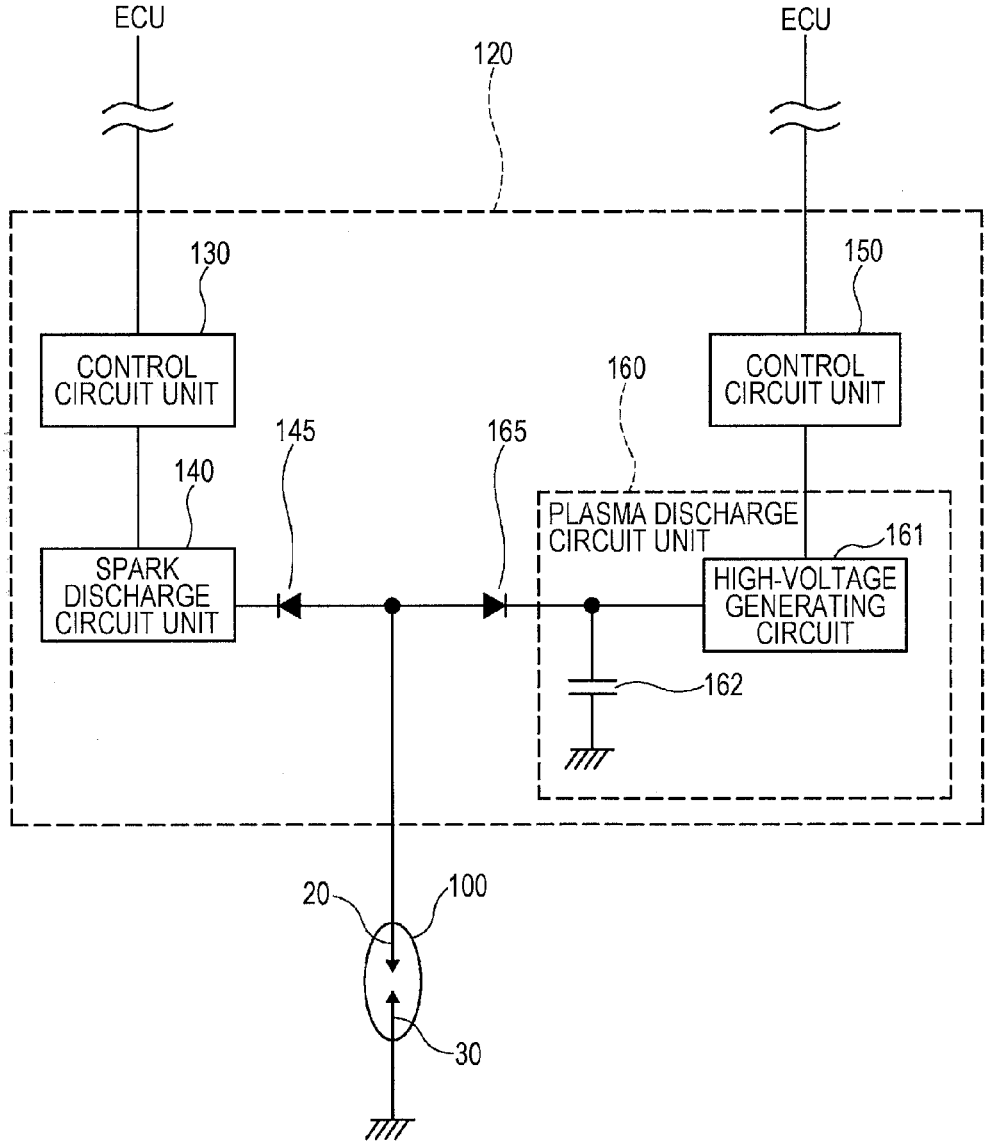
FIG. 3 is a schematic block diagram illustrating the structure of an example of an ignition system 120.

A-2. Operation of Plasma Jet Plug:

FIG. 3 is a schematic block diagram illustrating the structure of an example of an ignition system 120. The plasma jet plug 100 is connected to the ignition system 120, an example of which is illustrated in FIG. 3. The plasma jet plug 100 receives electric power from the ignition system 120, and thereby ignites the air-fuel mixture in the combustion chamber of the internal combustion engine.

The ignition system 120 supplies electric power to the plasma jet plug 100 in accordance with an instruction from an ECU (electronic control circuit) of an automobile. The ignition system 120 includes a spark discharge circuit unit 140, a plasma discharge circuit unit 160, control circuit units 130 and 150, and two backflow prevention diodes 145 and 165.

The spark discharge circuit unit 140 is a power supply circuit for performing a so-called trigger discharge in which a high voltage is applied to the gap between the center electrode 20 and the ground electrode 30 of the plasma jet plug 100 so that a spark discharge occurs due to dielectric breakdown. The spark discharge circuit unit 140 is controlled by the control circuit unit 130, which is connected to the ECU. The spark discharge circuit unit 140 is electrically connected to the center electrode 20 of the plasma jet plug 100, to which the electric power is supplied, with the diode 145 provided therebetween.

The plasma discharge circuit unit 160 is a power supply circuit for supplying high energy to the gap at which the dielectric breakdown is caused as a result of the trigger discharge performed by the spark discharge circuit unit 140. The plasma discharge circuit unit 160 is controlled by the control circuit unit 150, which is connected to the ECU. The plasma discharge circuit unit 160 is also connected to the center electrode 20 of the plasma jet plug 100 with the backflow prevention diode 165 provided therebetween. The ground electrode 30 of the plasma jet plug 100 is grounded via the metallic shell 50.

The plasma discharge circuit unit 160 includes a capacitor 162 that stores electric energy and a high-voltage generating circuit 161 that charges the capacitor 162. The capacitor 162 is grounded at one end and is connected to the high-voltage generating circuit 161, and to the center electrode 20 with the diode 165 provided therebetween. The amount of energy EG (unit is mJ) supplied to the spark gap to eject the plasma once is the sum of the amount of energy supplied by the trigger discharge and the amount of energy supplied from the capacitor 162. The capacitance of the capacitor 162 is adjusted so that the amount of energy EG is a predetermined value. The plasma jet plug 100 may also be driven by an ignition system in which, for example, the plasma discharge circuit unit 160 is not provided and the energy is supplied only by the trigger discharge. However, when the ignition system 120 illustrated in FIG. 3 is used, the energy of the generated plasma can be increased.

When the ignition system 120 supplies a high voltage to the gap in the plasma jet plug 100 and the discharge occurs in the gap, the gas in the cavity CV illustrated in FIG. 2 is excited by the energy supplied from the ignition system 120, so that plasma is generated in the cavity CV. When the plasma generated in the cavity CV expands and the pressure in the cavity CV increases, the plasma in the cavity CV is ejected from the through hole 31 in the ground electrode 30 in the shape of a pillar of flame. The air-fuel mixture in the combustion chamber of the internal combustion engine is ignited by the ejected plasma.

A-3. Structure of Portion of Plasma Jet Plug 100 around Front End

Figure 4:
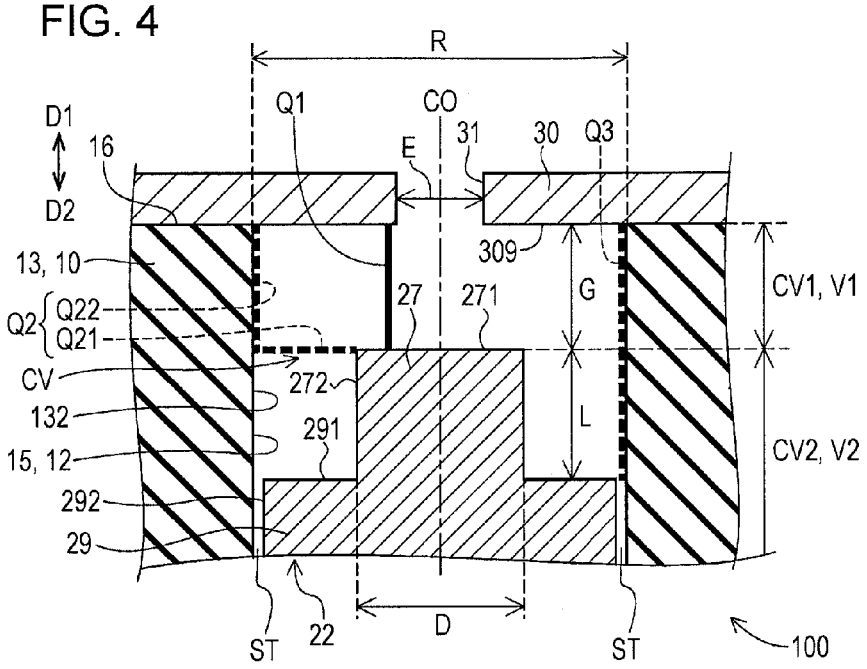
FIG. 4 is a sectional view of a portion of the plasma jet plug 100 around the front end.

The structure of a portion of the above-described plasma jet plug 100 around the front end thereof will be further described in detail. FIG. 4 is a sectional view of a portion of the plasma jet plug 100 around the front end taken along a plane including the axis CO. In FIG. 4, the front direction D1 is upward and the rear direction D2 is downward.

The inner diameter of the electrode receiving hole 15 is constant from the region in which the leg 22 of the center electrode 20 is accommodated to the front end surface 16. The leg 22 of the center electrode 20 includes the first portion 27, which includes a front end surface 271 of the center electrode 20, and the second portion 29, which has an outer diameter greater than that of the first portion 27 and which is connected to the rear end of the first portion 27. The first portion 27 has a columnar shape having an outer diameter D, and is centered on the axis CO. The outer diameter D is the outer diameter of the front end surface 271 of the center electrode 20, that is, the width D thereof in the radial direction. The second portion 29 has a columnar shape and is centered on the axis CO. The second portion 29 connects the head 21 (FIG. 2) to the first portion 27. The outer diameter of the second portion 29 is slightly smaller than the inner diameter of the electrode receiving hole 15. The width of a gap ST between an outer peripheral surface 292 of the second portion 29 and an inner peripheral surface 132 of the elongated leg 13 (width in the radial direction in this case) is set to a value that is small but large enough to prevent the elongated leg 13 from being damaged due to thermal expansion of the leg 22 (about 0.05 mm). The gap ST extends to the sealing position Pz in FIG. 2.

The cavity CV is defined by surfaces of the center electrode 20, the inner surface of the insulator 10, and the surface of the ground electrode 30 facing in the rear direction D2. More specifically, the main portion of the cavity CV is the space surrounded by the surface 309 of the ground electrode 30 facing in the rear direction D2, the inner peripheral surface 132 of the insulator 10 that defines the electrode receiving hole 15, the surface 291 of the second portion 29 of the center electrode 20 facing in the front direction D1, and the outer peripheral surface 272 and the front end surface 271 of the first portion 27 of the center electrode 20. In the present embodiment, the cavity CV also includes the above-described gap ST. The through hole 31 in the ground electrode 30 is excluded from the cavity CV. Thus, the cavity CV is the space over which the plasma is capable of spreading before being ejected through the through hole 31. In other words, the cavity CV is the space that communicates with the through hole 31 in the ground electrode 30. In the figure, the inner diameter E is the inner diameter of the through hole 31. In the present embodiment, the inner diameter E is smaller than the outer diameter D of the front end surface 271 of the center electrode 20.

FIGS. 2 and 4 illustrate a front portion CV1 and a rear portion CV2 of the cavity CV. The front portion CV1 is a portion of the cavity CV that is in the front direction D1 from the front end of the center electrode 20 (front end surface 271 in this case). The front portion CV1 is a portion of the cavity CV in which sparks are expected to flow. A first volume V1 is the volume of the front portion CV1. The inner diameter R is the inner diameter of the front portion CV1 (also referred to as a cavity diameter R). In the present embodiment, the cavity diameter R is greater than the outer diameter D. The rear portion CV2 is a portion of the cavity CV that is in the rear direction D2 from the front end of the center electrode 20 (front end surface 271 in this case). The rear portion CV2 is a portion of the cavity CV in which sparks are not expected to flow. As illustrated in FIG. 2, the rear portion CV2 is a portion that extends between the sealing position Pz and the front end of the center electrode 20 (front end surface 271). A second volume V2 is the volume of the rear portion CV2. An axial length L is the length of a portion of the center electrode 20 that is disposed in the main portion of the cavity CV in the direction of the axis CO. In other words, the axial length L is the length of a portion of the center electrode 20 that projects in the cavity CV. In the present embodiment, the axial length L is the distance between the front end surface 271 of the center electrode 20 and the surface 291 of the second portion 29 along the axis CO. A gap length G is the minimum distance between the center electrode 20 and the ground electrode 30. In the present embodiment, the gap length G is equal to the distance between the front end surface 271 of the center electrode 20 and the surface 309 of the ground electrode 30 along the axis CO. The gap length G is equal to the length of the front portion CV1 along the axis CO.

FIG. 4 illustrates three paths Q1, Q2, and Q3 as examples of discharge paths from the center electrode 20 to the ground electrode 30. There are two types of discharge paths: gaseous discharge paths and creeping discharge paths. The gaseous discharge paths are paths that extend through the space in the cavity CV. The creeping discharge paths are paths that extend along surfaces of the members of the plasma jet plug 100 (for example, along the inner peripheral surface 132 of the insulator 10).

The first path Q1 is a gaseous discharge path that extends parallel to the axis CO in the front direction D1 from the front end surface 271 of the center electrode 20 to the ground electrode 30 through the space in the cavity CV (also referred to as a gaseous discharge path Q1). The gaseous discharge path Q1 is the shortest discharge path from the center electrode 20 to the ground electrode 30. In the present embodiment, discharge along the gaseous discharge path Q1 is expected.

The second path Q2 includes a first portion Q21 and a second portion Q22. The first portion Q21 is a gaseous discharge path that extends in the radial direction from the front end of the center electrode 20 (edge of the front end surface 271) to the inner peripheral surface 132 of the insulator 10. The second portion Q22 is a creeping discharge path that extends parallel to the axis CO in the front direction D1 along the inner peripheral surface 132 of the insulator 10 from the end of the first portion Q21 on the inner peripheral surface 132 of the insulator 10 to the ground electrode 30.

The third path Q3 is a creeping discharge path that extends parallel to the axis CO in the front direction D1 along the inner peripheral surface 132 of the insulator 10 from the position where the end of the second portion 29 of the center electrode 20 in the front direction D1 faces the inner peripheral surface 132 of the insulator 10 in the radial direction to the ground electrode 30 (also referred to as the creeping discharge path Q3).

In the case where the discharge occurs along a path including a creeping discharge path, the creeping discharge path is preferably short. This is because of the following reason. That is, when the discharge occurs along a creeping discharge path, the insulator 10 is damaged by the energy of the sparks. For example, scratches may be formed on the insulator 10, or formation of groove-shaped cuts called channeling may occur. As a result, the durability of the plasma jet plug 100 may be reduced.

In addition, in the case where the discharge occurs along a creeping discharge path, the discharge path passes through a position distant from the through hole 31 in the ground electrode 30. The plasma is generated along the discharge path. Therefore, in the case where the discharge occurs along a creeping discharge path, the plasma is generated in a region distant from the through hole 31, and the ejection force applied to the plasma tends to be reduced. When the ejection force applied to the plasma is reduced, the energy for igniting the air-fuel mixture in the combustion chamber is reduced. As a result, the ignition performance of the plasma jet plug 100 will be reduced.

In addition, the ejection force applied to the plasma easily decreases when the volume of the cavity CV is excessively large. This is because since the energy of the plasma generated by the discharge is small relative to the volume of the cavity CV, the pressure in the cavity CV is increased only by a small amount, and the ejection force decreases accordingly. When the above-described channeling occurs, the volume of the cavity CV increases. Therefore, the ejection force applied to the plasma may decrease.

To evaluate the relationship between the structure and performance of the plasma jet plug 100, evaluation tests were performed by using samples of plasma jet plugs. In the evaluation tests, samples of a second embodiment and a third embodiment, which will be described below, were evaluated in addition to samples of the first embodiment illustrated in FIG. 4. The second and third embodiments will be described first, and then the evaluation tests will be described.

B. Second Embodiment

Figure 5:
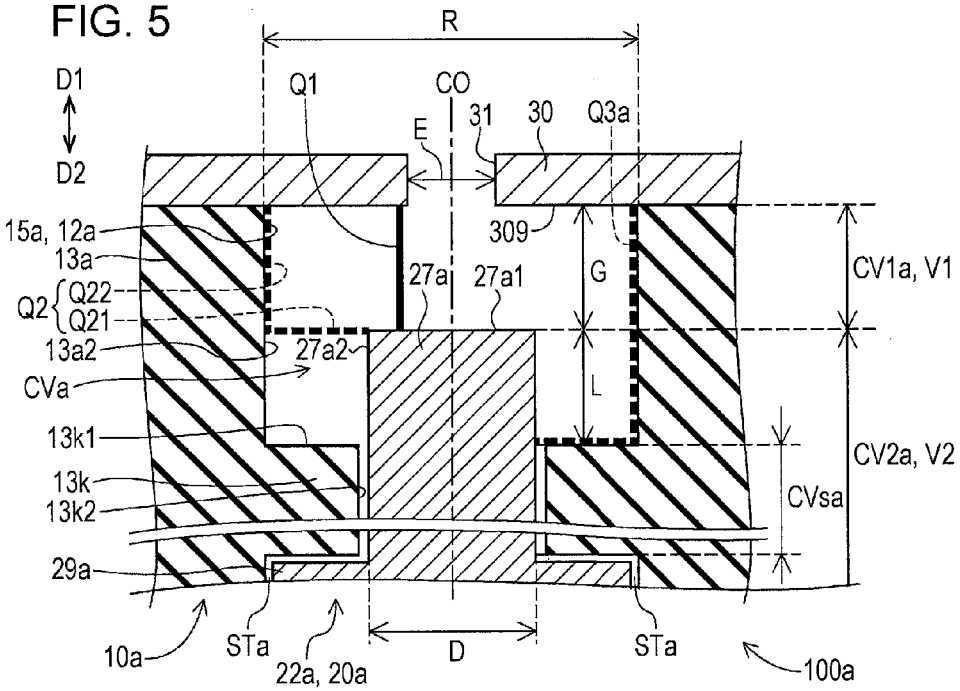
FIG. 5 is a diagram illustrating a plasma jet plug 100*a* according to a second embodiment.

FIG. 5 is a diagram illustrating a plasma jet plug 100*a* according to the second embodiment. This diagram is a sectional view of a portion of the plasma jet plug 100*a* around the front end taken along a plane including the axis CO. The only differences from the plasma jet plug 100 illustrated in FIG. 4 are that the connection position between a first portion 27*a* and a second portion 29*a* of a leg 22*a* of a center electrode 20*a* is shifted in the rear direction D2, and that an insulator 10*a* includes a small-diameter portion 13*k*. The structures of the other sections of the plasma jet plug 100*a* are the same as those of the plasma jet plug 100 illustrated in FIGS. 1, 2, and 4. In the following description, components of the plasma jet plug 100*a* that are the same as those of the plasma jet plug 100 are denoted by the same reference numerals, and descriptions thereof are thus omitted.

The structure of the first portion 27*a* of the leg 22*a* of the center electrode 20*a* is the same as that obtained by extending the first portion 27 illustrated in FIG. 4 in the rear direction D2. The outer diameter D shown in the figure is the outer diameter of a front end surface 27*a*1 of the center electrode 20*a*. In the present embodiment, the outer diameter D is the outer diameter of the first portion 27*a*. The structure of the second portion 29*a* of the leg 22*a* is the same as that obtained by shortening the second portion 29 illustrated in FIG. 4 in the rear direction D2. The first portion 27*a* is connected to the end of the second portion 29*a* in the front direction D1.

The structure of an elongated leg 13*a* of the insulator 10*a* is the same as that obtained by adding the small-diameter portion 13*k* to the elongated leg 13 illustrated in FIG. 4. The small-diameter portion 13*k* has a cylindrical shape and is centered on the axis CO. The structure of an inner peripheral surface 13*a*2 of a portion of the elongated leg 13*a* other than the small-diameter portion 13*k* is the same as that of the inner peripheral surface 132 in FIG. 4. The inner diameter of the small-diameter portion 13*k* is smaller than the inner diameter of the inner peripheral surface 13*a*2 of the elongated leg 13*a*. The small-diameter portion 13*k* is located in the front direction D1 from the second portion 29*a* of the center electrode 20*a*. The first portion 27*a* of the center electrode 20 is disposed in a region surrounded by the small-diameter portion 13*k*. The front end of the first portion 27*a* projects from the small-diameter portion 13*k* in the front direction D1. The inner diameter of the small-diameter portion 13*k* is slightly larger than the outer diameter of the first portion 27*a*. In a region in the rear direction D2 from a surface 13*k*1 of the small-diameter portion 13*k* facing in the front direction D1, a gap STa between the insulator 10*a* and the center electrode 20*a* has a width similar to that of the gap ST illustrated in FIG. 4, and extends to the sealing position Pz in FIG. 2. The surface 13*k*1 of the small-diameter portion 13*k* facing in the front direction D1 is hereinafter also referred to as "front surface 13*k*1".

The cavity CVa shown in the figure is defined by surfaces of the center electrode 20*a*, inner surfaces of the insulator 10*a* that define an axial hole 12*a*, and the surface 309 of the ground electrode 30 facing in the rear direction D2. More specifically, the main portion of the cavity CVa is the space surrounded by the surface 309 of the ground electrode 30 facing in the rear direction D2, a portion of the inner peripheral surface 13*a*2, which defines an electrode receiving hole 15*a* of the insulator 10*a*, in the front direction D1 from the small-diameter portion 13*k*, the front surface 13*k*1 of the small-diameter portion 13*k*, and an outer peripheral surface 27*a*2 and the front end surface 27*a*1 of the first portion 27*a* of the center electrode 20*a*. In the present embodiment, the cavity CVa also includes the above-described gap STa.

The illustrated cavity CVa includes a front portion CV1*a* and a rear portion CV2*a*. The front portion CV1*a* is a portion of the cavity CVa that is in the front direction D1 from the front end of the center electrode 20*a* (front end surface 27*a*1 in this case). The first volume V1 is the volume of the front portion CV1*a*. The cavity diameter R is the inner diameter of the front portion CV1*a*. The rear portion CV2*a* is a portion of the cavity CVa that is in the rear direction D2 from the front end of the center electrode 20*a* (front end surface 27*a*1 in this case). The rear portion CV2*a* is a portion that extends between the sealing position Pz (FIG. 2) and the front end of the center electrode 20*a* (front end surface 27*a*1). The second volume V2 is the volume of the rear portion CV2*a*. The axial length L is the length of a portion of the center electrode 20*a* in the main portion of the cavity CVa in the direction of the axis CO. In other words, the axial length L is the length of a portion of the center electrode 20*a* that projects in the cavity CVa. In the present embodiment, the axial length L is the distance between the front end surface 27*a*1 of the center electrode 20*a* and the front surface 13*k*1 of the small-diameter portion 13*k* of the insulator 10*a* along the axis CO. The gap length G is the minimum distance between the center electrode 20*a* and the ground electrode 30. In the present embodiment, the gap length G is the distance between the front end surface 27*a*1 of the center electrode 20*a* and the surface 309 of the ground electrode 30 along the axis CO.

Three paths Q1, Q2, and Q3*a* are illustrated as examples of discharge paths from the center electrode 20*a* to the ground electrode 30. The first path Q1 and the second path Q2 are the same as the first path Q1 and the second path Q2 in FIG. 4. The third path Q3*a* is a creeping discharge path that extends along the front surface 13*k*1 of the small-diameter portion 13*k* in the radial direction from the outer peripheral surface 27*a*2 of the first portion 27*a* of the center electrode 20*a* to the inner peripheral surface 13*a*2, and then extends parallel to the axis CO in the front direction D1 along the inner peripheral surface 13*a*2 to the ground electrode 30 (also referred to as a creeping discharge path Q3*a*).

C. Third Embodiment

Figure 6:
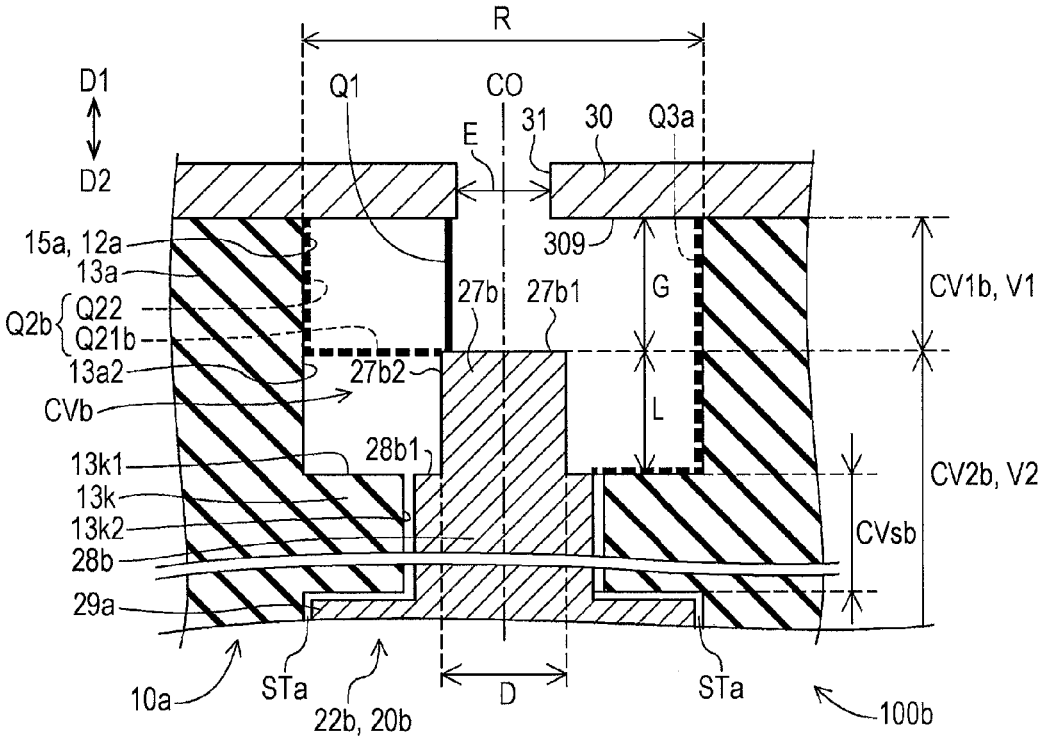
FIG. 6 is a diagram illustrating a plasma jet plug 100*b* according to a third embodiment.

FIG. 6 is a diagram illustrating a plasma jet plug 100*b* according to the third embodiment. This diagram is a sectional view of a portion of the plasma jet plug 100*b* around the front end taken along a plane including the axis CO. The only difference from the plasma jet plug 100 illustrated in FIG. 5 is that a portion 27*b* of a leg 22*b* of a center electrode 20*b* that is in the front direction D1 from the front surface 13*k*1 of the small-diameter portion 13*k* has an outer diameter smaller than that of a portion 28*b* disposed in a region surrounded by the small-diameter portion 13*k* of the insulator 10*a*. The structures of the other sections of the plasma jet plug 100*b* are the same as those of the plasma jet plug 100*a* illustrated in FIG. 5. In the following description, components of the plasma jet plug 100*b* that are the same as those of the plasma jet plug 100*a* are denoted by the same reference numerals, and descriptions thereof are thus omitted.

The structure of the second portion 29*a* of the leg 22*b* of the center electrode 20*b* is the same as the structure of the second portion 29*a* in FIG. 5.

The structure of the portion 28*b* of the leg 22*b* of the center electrode 20*b* that is disposed in the region surrounded by the small-diameter portion 13*k* of the insulator 10*a* (hereinafter referred to as "surrounded portion 28*b*") is the same as that of a portion of the first portion 27*a* that is disposed in the region surrounded by the small-diameter portion 13*k* in FIG. 5. The surrounded portion 28*b* has a columnar shape and is centered on the axis CO. The gap STa between the insulator 10*a* and the center electrode 20*b* is the same as the gap STa in FIG. 5.

The portion 27*b* of the leg 22*b* of the center electrode 20*b* that projects from the front surface 13*k*1 of the small-diameter portion 13*k* of the insulator 10*a* in the front direction D1 (hereinafter referred to as "projecting portion 27*b*") has a columnar shape and is centered on the axis CO. The outer diameter of the projecting portion 27*b* is smaller than that of the surrounded portion 28*b*. In the diagram, the outer diameter D is the outer diameter of a front end surface 27*b*1 of the center electrode 20*a*. In the present embodiment, the outer diameter D is the outer diameter of the projecting portion 27*b*.

The cavity CVb shown in the figure is defined by surfaces of the center electrode 20*b*, inner surfaces of the insulator 10*a* that define an axial hole 12*a*, and the surface 309 of the ground electrode 30 facing in the rear direction D2. More specifically, the main portion of the cavity CVb is the space surrounded by the surface 309 of the ground electrode 30 facing in the rear direction D2, a portion of the inner peripheral surface 13*a*2, which defines the electrode receiving hole 15*a* of the insulator 10*a*, in the front direction D1 from the small-diameter portion 13*k*, the front surface 13*k*1 of the small-diameter portion 13*k*, a surface 28*b*1 of the surrounded portion 28*b* of the center electrode 20*b* facing in the front direction D1, and an outer peripheral surface 27*b*2 and the front end surface 27*b*1 of the projecting portion 27*b*. In the present embodiment, the cavity CVb also includes the above-described gap STa.

The illustrated cavity CVb includes a front portion CV1*b* and a rear portion CV2*b*. The front portion CV1*b* is a portion of the cavity CVb that is in the front direction D1 from the front end of the center electrode 20*b* (front end surface 27*b*1 in this case). The first volume V1 is the volume of the front portion CV1*b*. The cavity diameter R is the inner diameter of the front portion CV1*b*. The rear portion CV2*b* is a portion of the cavity CVb that is in the rear direction D2 from the front end of the center electrode 20*b* (front end surface 27*b*1 in this case). The rear portion CV2*b* is a portion that extends between the sealing position Pz (FIG. 2) and the front end of the center electrode 20*b* (front end surface 27*b*1). The second volume V2 is the volume of the rear portion CV2*b*. The axial length L is the length of a portion of the center electrode 20*b* in the main portion of the cavity CVb in the direction of the axis CO. In other words, the axial length L is the length of a portion of the center electrode 20*b* that projects in the cavity CVb. In the present embodiment, the axial length L is the distance between the front end surface 27*b*1 of the center electrode 20*b* and the front surface 13*k*1 of the small-diameter portion 13*k* of the insulator 10*a* along the axis CO. The gap length G is the minimum distance between the center electrode 20*b* and the ground electrode 30. In the present embodiment, the gap length G is the distance between the front end surface 27*b*1 of the center electrode 20*b* and the surface 309 of the ground electrode 30 along the axis CO.

Three paths Q1, Q2*b*, and Q3*a* are illustrated as examples of discharge paths from the center electrode 20*b* to the ground electrode 30. The first path Q1 and the third path Q3*a* are the same as the first path Q1 and the third path Q3*a* in FIG. 5. The second path Q2*b* includes a first portion Q21*b* and a second portion Q22. The first portion Q21*b* is a gaseous discharge path that extends in the radial direction from the front end of the center electrode 20*b* (edge of the front end surface 27*b*1) to the inner peripheral surface 13*a*2 of the insulator 10*a*. The second portion Q22 is the same as the second portion Q22 in FIG. 5. More specifically, the second portion Q22 is a creeping discharge path that extends parallel to the axis CO in the front direction D1 along the inner peripheral surface 13*a*2 of the insulator 10*a* from the end of the first portion Q21*b* on the inner peripheral surface 13*a*2 of the insulator 10 to the ground electrode 30.

D. Evaluation Tests

The evaluation tests performed by using samples of the plasma jet plugs will be described. In the evaluation tests, the plasma ejection performance, likelihood of occurrence of channeling, and durability were evaluated. Table 1 provided below shows the result of the first evaluation test.

electrode and the dimensions of portions of the insulator. The first volume V1 is rounded to one decimal place, the second volume V2 is rounded to one decimal place, and the ratio VR is rounded to three decimal places. The volumes V1 and V2 are expressed in units of "mm$^3$". The reference numerals of the plasma jet plugs (more specifically, 100 (FIG. 4), 100*a* (FIG. 5), and 100*b* (FIG. 6)) are used to represent the shape of each sample. As is clear from the table, sample No. 15 has the same shape as that of the plasma jet plug 100*a* illustrated in FIG. 5, sample No. 16 has the same shape as that of the plasma jet plug 100*b* illustrated in FIG. 6, and the remaining samples have the same shape as that of the plasma jet plug 100 illustrated in FIG. 4. The inner diameter E and the outer diameter D are expressed in units of "mm".

Supplementary information of the samples will be described. The cavity diameter R is 3.5 mm for all of the samples. The gap length G is 0.5 mm for four samples (No. 8 to No. 14), and is 0.8 mm for the remaining samples. As is clear from Table 1, seven samples (No. 1 to No. 7) have the same first volume V1 (7.7 mm$^3$) and different second volumes V2. Seven samples (No. 8 to No. 14) have the same first volume V1 (4.8 mm$^3$) and different second volumes V2. Four samples (No. 15 to No. 18) have the same first volume V1 (7.7 mm$^3$), the same second volume V2 (38.0 mm$^3$), and different shapes or inner diameters E. Three samples (No. 19 to No. 21) have the same first volume V1 (7.7 mm$^3$) and different second volumes V2 and outer diameters D. The second volume V2 is adjusted by adjusting the axial length L (that is, the length of the front portion of the center electrode and the length of the elongated leg of the insulator).

TABLE 1

| No. | Volume V1 (mm$^3$) | Volume V2 (mm$^3$) | Ratio VR (V1/V2) | Shape | Inner Diameter E (mm) | Outer Diameter D (mm) | Ejection Performance | Channeling | Durability |
|---|---|---|---|---|---|---|---|---|---|
| 1 | 7.7 | 39.7 | 0.194 | 100 | 1.0 | 1.0 | C | B | B |
| 2 | 7.7 | 38.0 | 0.203 | 100 | 1.0 | 1.0 | B | B | B |
| 3 | 7.7 | 36.2 | 0.212 | 100 | 1.0 | 1.0 | B | B | B |
| 4 | 7.7 | 34.4 | 0.223 | 100 | 1.0 | 1.0 | B | B | B |
| 5 | 7.7 | 13.2 | 0.581 | 100 | 1.0 | 1.0 | B | B | B |
| 6 | 7.7 | 12.4 | 0.622 | 100 | 1.0 | 1.0 | B | B | B |
| 7 | 7.7 | 11.5 | 0.670 | 100 | 1.0 | 1.0 | B | C | B |
| 8 | 4.8 | 24.7 | 0.194 | 100 | 1.0 | 1.0 | C | B | B |
| 9 | 4.8 | 23.0 | 0.209 | 100 | 1.0 | 1.0 | B | B | B |
| 10 | 4.8 | 21.2 | 0.227 | 100 | 1.0 | 1.0 | B | B | B |
| 11 | 4.8 | 19.4 | 0.247 | 100 | 1.0 | 1.0 | B | B | B |
| 12 | 4.8 | 8.8 | 0.544 | 100 | 1.0 | 1.0 | B | B | B |
| 13 | 4.8 | 7.9 | 0.605 | 100 | 1.0 | 1.0 | B | B | B |
| 14 | 4.8 | 7.1 | 0.681 | 100 | 1.0 | 1.0 | B | C | B |
| 15 | 7.7 | 38.0 | 0.203 | 100a | 1.0 | 1.0 | B | A | B |
| 16 | 7.7 | 38.0 | 0.203 | 100b | 1.0 | 1.0 | B | A | B |
| 17 | 7.7 | 38.0 | 0.203 | 100 | 0.7 | 1.0 | A | B | B |
| 18 | 7.7 | 38.0 | 0.203 | 100 | 0.5 | 1.0 | A | B | B |
| 19 | 7.7 | 35.6 | 0.216 | 100 | 1.0 | 1.3 | B | B | A |
| 20 | 7.7 | 33.8 | 0.228 | 100 | 1.0 | 1.5 | B | B | A |
| 21 | 7.7 | 28.7 | 0.268 | 100 | 1.0 | 1.7 | B | B | A |

Table 1 shows the relationships between the sample number, the first volume V1, the second volume V2, the ratio VR of the first volume V1 to the second volume V2, the shape of the sample, the inner diameter E of the through hole 31 in the ground electrode 30, the outer diameter D of the front end surface of the center electrode, the evaluation result regarding ejection performance, the evaluation result regarding channeling, and the evaluation result regarding durability. The volumes V1 and V2 and the ratio VR are calculated from the dimensions of portions of the center In the ejection performance evaluation test, the size of the plasma (flame) ejected from the through hole 31 in the ground electrode 30 was measured by so-called Schlieren photography. More specifically, a predetermined power supply device (full-transistor ignition system in this case) was made to supply discharge energy of 100 mJ to the chamber while the chamber was pressurized to 0.6 MPa, so that a single spark discharge occurred. Then, after 100 μs from the spark discharge, a Schlieren image of the plasma ejected from the through hole 31 in the ground electrode 30 was captured. The captured Schlieren image was binarized by using a predetermined threshold so that pixels of the Schlieren image were divided into pixels representing high-density regions and pixels representing low-density regions. The number of pixels representing high-density regions was determined as the size of the ejected plasma. The size of the ejected plasma increases as the ejection force applied to the plasma increases. Ten Schlieren images were obtained for each sample, and the average of the plasma sizes calculated for the ten Schlieren images was determined as the plasma size of the sample.

In Table 1, the ejection performance is evaluated as A, B, or C as follows:

A: 1500 pixels≤Plasma Size

B: 800 pixels Plasma≤Size<1500 pixels

C: Plasma Size<800 pixels

In the channeling evaluation test, the discharge was caused to occur a predetermined number of times (50 times in this case), and the ratio of the number of times the discharge occurred along only a gaseous discharge path and no creeping discharge path was used to the number of times the discharge occurred along a path including a creeping discharge path was determined (hereinafter referred to as gaseous discharge ratio). More specifically, a high voltage capable of causing a discharge was applied to a sample so that a single spark discharge occurred. An image of the discharge path in the cavity was captured through the through hole 31 in the ground electrode 30 by using a high-speed camera. Whether or not the discharge occurred along a creeping discharge path was determined based on the captured image. This process was performed 50 times to determine the gaseous discharge ratio. In Table 1, the channeling is evaluated as A, B, or C as follows:

A: 0.7≤Gaseous Discharge Ratio

B: 0.5≤Gaseous Discharge Ratio<0.7

C: Gaseous Discharge Ratio<0.5

In the durability evaluation test, first, each sample was subjected to a predetermined durability test. In the durability test, each sample was subjected to a discharge test in which a spark discharge was caused to occur 20 times per second for 30 hours. Then, the above-described channeling evaluation test was performed for the samples subjected to the durability test. In Table 1, the durability is evaluated as A, B, or C based on the same criteria as those for the channeling evaluation.

As is clear from the results for samples No. 1 to No. 7 and samples No. 8 to No. 14, the ejection performance for when the ratio VR is large (evaluation result B for VR=0.203, 0.212, 0.223, 0.581, 0.622, 0.670, 0.209, 0.227, 0.247, 0.544, 0.605, and 0.681) is higher than that for when the ratio VR is low (evaluation result C for VR=0.194). This is presumably because when the ratio VR is high, the plasma can be appropriately generated in a front region of the cavity without making the volume of the cavity excessively large.

The first volume V1 for samples No. 1 to No. 7 is 7.7 $mm^3$, and the first volume V1 for samples No. 8 to No. 14 is 4.8 $mm^3$. For these two first volumes V1 that differ by a large amount, the ejection performance is evaluated as C when the ratio VR is lower than 0.20 (No. 1 and No. 8), and as B when the ratio VR is higher than or equal to 0.20 (No. 2 to No. 7 and No. 9 to No. 14). Thus, it can be expected that the ejection performance can be improved for various first volumes V1 by setting the ratio VR to a value greater than or equal to 0.20.

As is clear from the results for samples No. 1 to No. 7 and samples No. 8 to No. 14, the channeling evaluation result for when the ratio VR is low (evaluation result B for VR=0.194, 0.203, 0.212, 0.223, 0.581, 0.622, 0.209, 0.227, 0.247, 0.544, and 0.605) is better than that for when the ratio VR is high (evaluation result C for VR=0.670 and 0.681). This is presumably because of the following reason. That is, when the ratio VR is low, the ratio of the second volume V2 of the rear portion CV2 to the volume V1 of the front portion CV1 (FIG. 4) is high. Therefore, the discharge path along the inner peripheral surface 132 of the insulator 10 (for example, the third path Q3) tends to be long in a region in the rear direction D2 from the front end of the center electrode 20 (front end surface 271 in this case). As a result, the possibility that the discharge occurs along a discharge path including a creeping discharge path (for example, the third path Q3) can be reduced, and the channeling evaluation result improves accordingly.

The first volume V1 for samples No. 1 to No. 7 is 7.7 $mm^3$, and the first volume V1 for samples No. 8 to No. 14 is 4.8 $mm^3$. For these two first volumes V1 that differ by a large amount, the channeling evaluation result is C when the ratio VR is higher than 0.622 (No. 7 and No. 14), and B when the ratio VR is lower than or equal to 0.622 (No. 1 to No. 6 and No. 8 to No. 13). Thus, it can be expected that the channeling evaluation result can be improved for various first volumes V1 by setting the ratio VR to a value smaller than or equal to 0.622, or smaller than or equal to 0.62.

The durability is evaluated as B for all of the samples No. 1 to No. 14. Therefore, it can be expected that when the ratio VR is set to a value greater than or equal to 0.20, damage to the insulator can be suppressed and the ejection performance can be improved at the same time. Also, it can be expected that when the ratio VR is set to a value smaller than or equal to 0.62, damage to the insulator can be suppressed and the channeling evaluation result can be improved at the same time.

Also for sample No. 15, which is a sample according to the second embodiment, sample No. 16, which is a sample according to the third embodiment, samples No. 17 and No. 18, for which the inner diameter E of the through hole 31 is changed, and samples No. 19, No. 20, and No. 21, for which the outer diameter D of the center electrode is changed, the ratio VR is higher than or equal to 0.20, and the ejection performance is evaluated as B or better. Thus, it can be expected that the ejection performance can be improved for plasma jet plugs having various structures (for example, various values for parameters D, E, G, and L or structures illustrated in FIGS. 4, 5, and 6) by setting the ratio VR to a value greater than or equal to 0.20.

In addition, for samples No. 15 to No. 21, the ratio VR is lower than or equal to 0.62, and the channeling evaluation result is B or better. Thus, it can be expected that the channeling evaluation result can be improved for plasma jet plugs having various structures (for example, various values for parameters D, E, G, and L or structures illustrated in FIGS. 4, 5, and 6) by setting the ratio VR to a value smaller than or equal to 0.62.

The ejection performance is evaluated as B or better and the channeling evaluation result is B or better for 17 samples for which the ratio VR is set to 13 values, which are 0.203 (No. 2, No. 15, No. 16, No. 17, and No. 18), 0.209 (No. 9), 0.212 (No. 3), 0.216 (No. 19), 0.223 (No. 4), 0.227 (No. 10), 0.228 (No. 20), 0.247 (No. 11), 0.268 (No. 21), 0.544 (No. 12), 0.581 (No. 5), 0.605 (No. 13), and 0.622 (No. 6). Any value selected from the 13 values may be set as the lower limit of a preferred range of the ratio VR (higher than or equal to a lower limit, and lower than or equal to an upper limit). For example, the ratio VR may be set to a value greater than or equal to 0.203. Among the ratios VR set in the evaluation tests, the highest ratio VR that is lower than the lowest value among the above-mentioned 13 values, that is, 0.203, is 0.194. Therefore, a value between these values (0.194 and 0.203), such as 0.20, may also be set as the lower limit of the preferred range of the ratio VR. In addition, among the 13 values, any value that is greater than or equal to the lower limit may be set as the upper limit. For example, the ratio VR may be set to a value smaller than or equal to 0.622, or smaller than or equal to 0.62. It can be expected that the upper and lower limits of the ratio VR may be set for plasma jet plugs having various structures (for example, various values for parameters D, E, G, and L or structures illustrated in FIGS. 4, 5, and 6).

As is clear from the results for samples No. 1 to No. 4, No. 17, and No. 18, which have similar ratios VR and the same first volume V1, ejection performance for when the inner diameter E of the ground electrode 30 is small (evaluation result A for E=0.7 and 0.5 (mm)) is higher than that for when the inner diameter E is large (evaluation result B or worse for E=1.0 (mm)). This is presumably because when the pressure increase in the cavity due to the discharge is constant, a stronger plasma jet comes out of the through hole 31 when the inner diameter E is small than when the inner diameter E is large.

The ejection performance is evaluated as A for two inner diameters E, which are 0.7 mm (No. 17) and 0.5 mm (No. 18). Either of these two values may be set as the upper limit of a preferred range of the inner diameter E (greater than or equal to a lower limit, and smaller than or equal to an upper limit).

For example, the inner diameter E may be set to a value smaller than or equal to 0.7 mm. Among the two values, any value that is smaller than or equal to the upper limit (for example, 0.5 mm) may be set as the lower limit. The lower limit of the inner diameter E may be set to a still smaller value (for example, 0.2 mm). When the inner diameter E is set to a value that is greater than or equal to 0.2 mm, the risk that the plasma cannot be ejected from the through hole 31 can be reduced.

It is presumed that the relationship between the inner diameter E and the ejection performance is mainly affected by the pressure increase in the cavity due to the discharge. Also, it is presumed that the influence of specific structures of the cavity, the center electrode, and the ground electrode (for example, values of the parameters D, G, and L and the structures illustrated in FIGS. 4, 5, and 6) is small. Therefore, it can be expected that the above-described preferred range of the inner diameter E may be applied to various plasma jet plugs for which the ejection performance may be evaluated as B or better, for example, various plasma jet plug having a ratio VR that is higher than or equal to 0.20. However, the inner diameter E may be out of the above-described preferred range.

As is clear from the results for samples No. 1 to No. 4, No. 19, No. 20, and No. 21, which have the same first volume V1 and similar ratios VR, the durability for when the outer diameter D of the front end surface of the center electrode is large (evaluation result A for D=1.3, 1.5, and 1.7 (mm)) is higher than that for when the outer diameter D is small (evaluation result B for D=1.0 (mm)). This is because the amount of increase in the gap length G (minimum distance between the center electrode and the ground electrode) due to wear of the center electrode is smaller when the outer diameter D is large than when the outer diameter D is small.

The durability is evaluated as A for three outer diameters D, which are 1.3 mm (No. 19), 1.5 mm (No. 20), and 1.7 mm (No. 21). Any value selected from these three values may be set as the lower limit of a preferred range of the outer diameter D (greater than or equal to a lower limit, and smaller than or equal to an upper limit). For example, the outer diameter D may be set to a value that is greater than or equal to 1.3 mm. Among the three values, any value that is greater than or equal to the lower limit (for example, 1.7 mm) may be set as the upper limit.

The upper limit of the outer diameter D may be set to a still greater value (for example, 2.0 mm). However, when the outer diameter D is excessively large, the minimum distance between the front end surface of the center electrode and the inner surface of the insulator in the radial direction (for example, (R−D)/2 in FIG. 4) is reduced, and therefore the discharge easily occurs along a discharge path including a creeping discharge path (for example, the second path Q2 in FIG. 4). Accordingly, the upper limit of the outer diameter D is preferably determined so that the discharge more easily occurs along a discharge path including only a gaseous discharge path (for example, the gaseous discharge path Q1 in FIG. 4) than along a discharge path including a creeping discharge path.

It is known that the gaseous discharge path has a resistance higher than that of the creeping discharge path even when the path lengths thereof are the same. Also, it is considered that, in the case where a constant voltage is applied, a spark discharge occurs along the gaseous discharge path when the path length of the gaseous discharge path is greater than or equal to twice the path length of the creeping discharge path. Therefore, it can be assumed that, by using a corrected path length for the creeping discharge path, the corrected path length being calculated by multiplying the path length of the creeping discharge path by a factor of (½), the two paths can be compared in terms of how easily the discharge occurs therealong. For example, in the embodiment illustrated in FIG. 4, it can be assumed that the spark discharge occurs along the gaseous discharge path Q1 when the upper limit of the outer diameter D is determined so that the corrected path length of the second path Q2 including the creeping discharge path is greater than or equal to the path length of the gaseous discharge path Q1. Since the second path Q2 is the combination of the first portion Q21 (length=(R−D)/2) and the second portion Q22 (length=G), the corrected path length of the second path Q2 can be calculated as "(R−D)/2+G/2=(R−D+G)/2". The path length of the gaseous discharge path Q1 is approximately equal to the distance G. Therefore, the outer diameter D is preferably determined such that (R−D+G)/2≥G, or (R−G)≥D, is satisfied. Thus, the outer diameter D is preferably set to a value that is smaller than or equal to "Cavity Diameter R−Gap Length G". Also in the case of the embodiments illustrated in FIGS. 5 and 6, the upper limit of the outer diameter D may be determined in a similar manner. In any case, the outer diameter D of the front end surface of the center electrode is preferably greater than the inner diameter E of the through hole 31 in the ground electrode 30.

It is presumed that the relationship between the outer diameter D and the durability is greatly affected by a change (increase) in the minimum distance between the center electrode and the ground electrode due to wear of the center electrode. Also, it is presumed that the influence of specific structures of the cavity, the center electrode, and the ground electrode (for example, values of the parameters E, G, and L and the structures illustrated in FIGS. 4, 5, and 6) is small. Therefore, it can be expected that the above-described preferred range of the outer diameter D may be applied to various plasma jet plugs for which the ejection performance may be evaluated as B or better, for example, various plasma jet plug having a ratio VR that is higher than or equal to 0.20. However, the outer diameter D may be out of the above-described preferred range.

As is clear from the results for samples No. 1 to No. 4, No. 15, and No. 16, which have similar ratios VR and the same first volume V1, the channeling evaluation result (A) for the samples of the second embodiment (No. 15) and the third embodiment (No. 16) is better than the channeling evaluation result (B) for the samples of the first embodiment (No. 1 to No. 4).

This is presumably because of the following reason. That is, in the embodiments illustrated in FIGS. 5 and 6, the cavities CVa and CVb include portions CVsa and CVsb (hereinafter referred to as "second portions CVsa and CVsb") having an inner diameter smaller than the inner diameter R of the front portions CV1*a* and CV1*b* (also referred to as first portions CV1*a* and CV1*b*) provided at the front end. The second portions CVsa and CVsb are defined by an inner peripheral surface 13*k*2 of the small-diameter portion 13*k* of the insulator 10*a*. The second portions CVsa and CVsb are located in the rear direction D2 from the first portions CV1*a* and CV1*b*, respectively. Such a structure is provided since the insulator 10*a* includes a portion having an inner diameter smaller than the inner diameter R (small-diameter portion 13*k* in this case). In this structure, the discharge path Q3*a*, which extends from the center electrode 20*a* or 20*b* to the ground electrode 30 along only the inner surface of the insulator 10*a*, extends along the front surface 13*k*1 of the small-diameter portion 13*k*. Therefore, the discharge path Q3*a* tends to be longer than the creeping discharge path Q3 in FIG. 4. As a result, in the embodiments illustrated in FIGS. 5 and 6, the possibility that the discharge will occur along the creeping discharge path Q3*a* is smaller than that in the embodiment illustrated in FIG. 4. This is presumably the reason why the channeling evaluation result for the samples of the second embodiment (No. 15) and the third embodiment (No. 16) is better than the channeling evaluation result for the samples of the first embodiment (No. 1 to No. 4).

The second portion that has an inner diameter smaller than the inner diameter R of the first portion disposed at the front end of the cavity (for example, the first portions CV1*a* and CV1*b* in FIGS. 5 and 6) may include a portion located in the front direction D1 from the front end of the center electrode. However, to suppress the discharge that occurs along only the creeping discharge path, as in the embodiments illustrated in FIGS. 5 and 6, the second portions CVsa and CVsb are preferably located in the rear direction D2 from the front end of the center electrode (front end surfaces 27*a*1 and 27*b*1 in this case). Thus, in the case where the insulator includes a diameter-increasing portion which is located in the rear direction D2 from the front end of the center electrode and at which the inner diameter of the cavity increases toward the downstream side in the front direction D1 (for example, the portion having the front surface 13*k*1 of the small-diameter portion 13*k* in FIG. 5), the minimum distance between the front end of the center electrode and the inner surface of the insulator in the radial direction can be increased. Therefore, the possibility that the discharge will occur along the creeping discharge path can be reduced.

E. Modifications (1) The cross section of the through hole 31 in the ground electrode 30 (more specifically, the cross section along a plane perpendicular to the axis CO) may have a non-circular shape. In any case, the maximum width of the through hole 31 (more specifically, the maximum width of the cross section along a plane perpendicular to the axis CO) is preferably within the above-described preferred range of the inner diameter E.

(2) The front end surface of the center electrode may have a non-circular shape. In any case, the maximum width of the front end of the center electrode (more specifically, the maximum width of the front end surface of the center electrode in a direction perpendicular to the axis CO) is preferably within the above-described preferred range of the outer diameter D.

(3) The maximum width of the through hole in the ground electrode may be greater than the maximum width of the front end surface of the center electrode, equal to the maximum width of the front end surface of the center electrode, or smaller than the maximum width of the front end surface of the center electrode. The through hole in the ground electrode may be formed such that the center axis thereof is displaced from the axis CO of the plasma jet plug. Similarly, the center electrode may be formed such that the center axis of the front end surface thereof is displaced from the axis CO of the plasma jet plug. In any case, preferably, when the ground electrode and the center electrode are projected in the direction of the axis CO onto a projection plane perpendicular to the axis CO, the through hole in the ground electrode at least partially overlap the front end surface of the center electrode on the projection plane. In such a case, the discharge easily occurs along the path that is near the through hole in the ground electrode, so that the ignition performance can be improved. One of the through hole in the ground electrode and the front end surface of the center electrode may be completely included in the other on the above-described projection plane. Alternatively, a portion of the through hole may be disposed outside the front end surface, or a portion of the front end surface may be disposed outside the through hole.

(4) The center electrode may have various structures instead of the above-described structure. For example, a circular conical portion having an outer diameter that decreases from the rear end thereof toward the front end thereof may be provided between the first portion 27 and the second portion 29 in FIG. 4. A tip that is highly resistant to discharge may be connected (for example, welded) to the front end of the center electrode. The tip may be made of a high melting metal. The high melting metal may be, for example, a precious metal (such as indium or platinum), tungsten, or an alloy containing a metal selected from a precious metal and tungsten as a main component.

(5) The ground electrode 30 may have various structures instead of the above-described structure. For example, a portion of the ground electrode 30 at which the discharge occurs (for example, a portion that defines the through hole 31 in FIG. 4, that is, a portion including the inner peripheral surface) is preferably made of the high melting metal material described above as the material of the center electrode. When the high melting metal material is used, wear of the ground electrode 30 due to the spark discharge can be suppressed.

The portion of the ground electrode 30 formed of a high melting metal material (for example, a material containing a precious metal or tungsten as a main component) preferably includes the portion of the ground electrode 30 at which the discharge occurs, and may be part of the ground electrode 30. A portion of the center electrode at which the discharge occurs and the portion of the ground electrode at which the discharge occurs may be made of different materials. The ground electrode 30 may be free from a portion made of a high melting material. In this case, the ground electrode 30 may be made of, for example, nickel or an alloy containing nickel as a main component.

(6) The plasma jet plug may have various structures instead of the above-described structure. For example, the inner diameter of the front portion of the cavity (for example, the front portion CV1 in FIG. 4) may vary depending on the position in the direction of the axis CO.

Although the present invention has been described based on the embodiments and modifications, the above-described embodiments of the present invention are intended to facilitate understanding of the present invention, and do not limit the present invention. The present invention allows modifications and improvements without departing from the spirit of the present invention and the scope of the claims, and includes equivalents thereof.

REFERENCE SIGNS LIST

4 conductive seal, 5 gasket, 6, 7 ring member, 9 talc, 10, 10*a* insulator, 10*z* thinning hole portion, 12, 12*a* axial hole, 13, 13*a* elongated leg, 13*k* small-diameter portion, 132, 13*a*2 inner peripheral surface, 13*k*1 front surface, 13*k*2 inner peripheral surface, 14 step portion, 15, 15*a* electrode receiving hole, 16 front end surface, 17 front body, 18 rear body, 19 flange, 20, 20*a*, 20*b* center electrode, 21 head, 22, 22*a*, 22*b* leg, 27, 27*a* first portion, 27*b* projecting portion, 271, 27*a*1, 27*b*1 front end surface, 272, 27*a*2, 27*b*2 outer peripheral surface, 28*b* surrounded portion, 28*b*1 surface, 29, 29*a* second portion, 291 surface, 292 outer peripheral surface, 30 ground electrode, 31 through hole, 309 surface, 40 terminal, 41 cap attachment portion, 42 flange, 43 leg, 50 metallic shell, 51 tool engagement portion, 52 threaded portion, 53 crimping portion, 54 seating portion, 56 engagement portion, 57 front end surface, 57A recess, 58 compressive deformation portion, 59 through hole, 80 plate packing, 100, 100*a*, 100*b* plasma jet plug, 120 ignition system, 130 control circuit unit, 140 spark discharge circuit unit, 145 diode, 150 control circuit unit, 160 plasma discharge circuit unit, 161 high-voltage generating circuit, 162 capacitor, 165 diode, CO axis, D outer diameter, E inner diameter, R cavity diameter (inner diameter), L axial length, G gap length, P sealing position, CV, CVa, CVb cavity, CV1, CV1*a*, CV1*b* front portion, V1 first volume, CV2, CV2*a*, CV2*b* rear portion, V2 second volume, CVsa second portion, D1 front direction, D2 rear direction, CO axis, ST gap, STa gap, Pz sealing position.

The invention claimed is:

1. A plasma jet plug comprising:

a tubular insulator having an inner surface that defines an axial hole that extends along an axis;

a rod-shaped center electrode that is disposed in the axial hole of the insulator and extends along the axis;

a metallic shell disposed around an outer periphery of the insulator;

a ground electrode that is electrically connected to the metallic shell, said ground electrode having a through hole and being abutted on a front side of the insulator; and a cavity that is defined by a surface of the center electrode, the inner surface of the insulator, and a surface of the ground electrode facing a rear side of the insulator, wherein an inner diameter of the through hole is smaller than an inner diameter of a portion of the insulator which abuts the ground electrode; and wherein, a following expression is satisfied:

V1/V2≥0.20, where a first volume V1 is a volume of a portion of the cavity on the front side of a front end of the center electrode, and a second volume V2 is a volume of a portion of the cavity on a rear side of the front end of the center electrode.

2. The plasma jet plug according to claim 1, wherein the through hole has a maximum width that is smaller than or equal to 0.7 mm.

3. The plasma jet plug according to claim 1, wherein the front end of the center electrode has a maximum width that is greater than or equal to 1.3 mm.

4. The plasma jet plug according to claim 1, wherein the cavity includes;

a first portion provided at the front side of the front end of the center electrode, and a second portion that is located on a rear side of the first portion and has a small diameter portion whose outer diameter is smaller than an inner diameter of the first portion.

5. The plasma jet plug according to claim 4, wherein the second portion is located on a rear side of the front end of the center electrode.

6. The plasma jet plug according to claim 1, wherein a following expression is satisfied:

V1/V2≤0.62.

7. The plasma jet plug according to claim 2, wherein the front end of the center electrode has a maximum width that is greater than or equal to 1.3 mm.

8. The plasma jet plug according to claim 2, wherein the cavity includes;

a first portion provided at the front side of the center electrode, and a second portion that is located on a rear side of the first portion and has an inner diameter smaller than an inner diameter of the first portion.

9. The plasma jet plug according to claim 3, wherein the cavity includes;

a first portion provided at the front side of the center electrode, and a second portion that is located on a rear side of the first portion and has an inner diameter smaller than an inner diameter of the first portion.

10. The plasma jet plug according to claim 2, wherein a following expression is satisfied:

V1/V2≤0.62.

11. The plasma jet plug according to claim 3, wherein a following expression is satisfied:

V1/V2≤0.62.

12. The plasma jet plug according to claim 4, wherein a following expression is satisfied:

V1/V2≤0.62.

13. The plasma jet plug according to claim 5, wherein a following expression is satisfied:

V1/V2≤0.62.

14. The plasma jet plug according to claim 4, wherein the outer diameter of the second portion is defined by the inner surface of the insulator.

* * * * *